US007121481B2

(12) United States Patent
Berglund et al.

(10) Patent No.: US 7,121,481 B2
(45) Date of Patent: Oct. 17, 2006

(54) FUEL INJECTOR

(75) Inventors: Joakim Berglund, Trollhattan (SE); Patrik Bäckander, Trollhattan (SE); Jens Dahlin, Trollhattan (SE); Hans Falk, Trollhattan (SE); Bernhard Gustafsson, Göteborg (SE); Klas Lindblad, Trollhattan (SE); Torbjörn Salomonsson, Vänersborg (SE)

(73) Assignee: Volvo Aero Corporation, Trollhättan (SE)

( * ) Notice: Subject to any disclaimer, the term of this patent is extended or adjusted under 35 U.S.C. 154(b) by 50 days.

(21) Appl. No.: 10/605,587

(22) Filed: Oct. 10, 2003

(65) Prior Publication Data

US 2004/0129797 A1 Jul. 8, 2004

Related U.S. Application Data

(60) Provisional application No. 60/319,601, filed on Oct. 10, 2002.

(51) Int. Cl.

| | |
|---|---|
| ***F02M 59/00*** | (2006.01) |
| ***F02M 61/00*** | (2006.01) |
| ***F02M 47/02*** | (2006.01) |
| ***B05B 1/30*** | (2006.01) |

(52) U.S. Cl. ..... 239/533.2; 239/533.12; 239/88; 239/585.5; 239/452

(58) Field of Classification Search ..... 239/533.2, 239/533.1, 533.3, 533.12, 585.1–585.5, 88–93, 239/452; 251/129.15, 129.21, 127
See application file for complete search history.

(56) References Cited

U.S. PATENT DOCUMENTS

| | | | | |
|---|---|---|---|---|
| 2,978,870 | A | | 1/1961 | Vdoviak |
| 3,002,353 | A | | 10/1961 | McEneny |
| 4,485,866 | A | | 12/1984 | Hermmerich et al. |
| 4,781,019 | A | | 11/1988 | Wagner |
| 4,887,425 | A | | 12/1989 | Vdoviak ..... 60/261 |
| 5,353,992 | A | * | 10/1994 | Regueiro ..... 239/533.12 |
| 5,881,957 | A | * | 3/1999 | Mizuno et al. ..... 239/533.2 |
| 5,947,389 | A | * | 9/1999 | Hasegawa et al. ..... 239/533.2 |
| 6,334,303 | B1 | | 1/2002 | Berglund et al. ..... 60/261 |
| 6,591,499 | B1 | | 7/2003 | Lundgren |
| 6,637,188 | B1 | | 10/2003 | Bichler et al. |

FOREIGN PATENT DOCUMENTS

| | | |
|---|---|---|
| GB | 215570 A | 11/1985 |
| WO | WO 02/055864 A1 | 7/2002 |

* cited by examiner

*Primary Examiner*—Davis Hwu
(74) *Attorney, Agent, or Firm*—Novak Druce & Quigg, LLP

(57) ABSTRACT

A fuel injector (1) having a chamber (7) with a fuel inlet (8) and a plurality of fuel outlets (10), and including a fuel distributor (18) that is arranged in the chamber (7) for the purpose of distributing fuel introduced into the chamber (7) via the fuel inlet (8) to the outlets (10). The fuel distributor (18) includes a generally rotary symmetric distributor body (19).

21 Claims, 4 Drawing Sheets

FUEL INJECTOR

CROSS REFERENCE TO RELATED APPLICATIONS

The present application claims the benefit of U.S. Provisional Application No. 60/319,601 filed 10 Oct. 2002.

BACKGROUND OF INVENTION

Technical Field

The present invention relates to a fuel injector, comprising a chamber with a fuel inlet and a plurality of fuel outlets, and comprising a fuel distributor that is arranged in the chamber for the purpose of distributing fuel introduced into the chamber via the fuel inlet to the outlets.

The invention also relates to a method of manufacturing such a fuel injector and an engine that comprises a combustion chamber and such a fuel injector for injecting fuel into the combustion chamber via the outlets of the chamber of the fuel injector. It should be understood that, according to the invention, the fuel could be injected either directly or indirectly via the fuel outlets of the fuel injector into the combustion chamber (or chambers).

"Fuel injector" should be understood in a broad sense and includes what is normally referred to as a spray bar in jet engine technology. Such spray bars are then provided for the purpose of injecting fuel into the afterburner of the engine in question.

"Engine" may include any engine which for its operation uses a fuel that is injected either in liquid or gaseous state into one or more combustion chambers and where there is a need of distributing the fuel in precise pre-determined amounts to the combustion chamber or chambers via the outlets of the fuel injector.

However, a particularly relevant application according the invention, includes jet engines equipped with an afterburner into which fuel needs to be injected with high precision during operation. Therefore, the invention will be described by way of example with reference to such a preferred application.

BACKGROUND

In the spray bar head of a jet engine equipped with an afterburner there is provided a chamber or a collector volume into which fuel, in liquid and/or gaseous state, is introduced via a fuel inlet provided in a wall portion of the spray bar head. The spray bar head also comprises a plurality of fuel outlets from the collector volume, said outlets being provided in another wall portion of the spray bar head than the fuel inlet. In the collector volume the fuel introduced via the inlet is primarily distributed to the outlets in predetermined amounts. Specific restriction elements may be provided at one or more outlets for the purpose of affecting the fuel flow rate individually for one or more outlets.

According to prior art, the collector volume is delimited by a cylinder and opposite end walls that are provided at opposite ends of the cylinder. The cylinder may comprise one or more portions with restricted width as well as one or more truncated portions. Typically the inlet is arranged in the cylinder wall and the outlets are provided in one of the end walls. For such a spray bar head geometry it has been found that, without any kind of fuel distributor provided inside the collector volume, there will be static pressure oscillations inside the collector volume, resulting in corresponding velocity fluctuations in of the fuel exiting via the fuel outlets, which in itself is a drawback with respect to the need of precise control of the fuel flow via the outlets.

Therefore, prior art suggests the use of a fuel distributor or a fuel distributing body arranged inside the collector volume. According to prior art, fuel distributors comprise one or more distributor bodies that are produced by way of casting, preferably in one piece with any one of the walls of the spray bar head, that wall then being attached to the adjacent wall or walls by means of welding or brazing.

SUMMARY OF INVENTION

The object of the invention is achieved by means of the initially defined fuel injector, characterized in that fuel distributor comprises a generally rotary symmetric distributor body. Rotary symmetric is referred to as presenting a generally circular outer periphery.

According to a preferred embodiment of the invention, the fuel injector chamber is delimited by at least one side wall, and said fuel distributor defines a lid or plug that forms an end wall in relation thereto. These features further enhances the production-related advantage of the design according to the invention.

Preferably, the fuel inlet is provided in the side wall and that the outlets are provided in an end wall.

According to the invention, the fuel outlets should be provided in an end wall opposite to an end wall that is formed by the fuel distributor or to which the distributor body is attached.

In further accordance with the invention, the fuel injector comprises a cylinder that defines the side wall, and the cylinder has a generally circular inner periphery.

Moreover, it is preferred, both from a production and a fuel flow point of view, that the distributor body is concentric with the cylinder.

The distributor body should be located in front of the fuel and cover the fuel inlet, in order to sufficiently affect the incoming flow of fuel in order to avoid any irregularities in the flow pattern that might induce flow wave oscillations in the collector chamber. In accordance with this feature the distributor body is both longer in length direction and wider in its width direction than the corresponding length and width of the fuel inlet or each individual fuel inlet to the collector chamber.

The object of the invention is also to present a method of manufacturing a fuel injector according to the invention that is advantageous from a production cost-saving point of view with regard to methods of producing corresponding fuel injectors according to prior art. This object is achieved by means of a method of manufacturing a fuel injector according to the invention, characterized in that the distributor body is produced by subjecting a work piece to a turning operation. Here, machining by way of a turning operation is regarded as favorable from production technical reasons when compared to casting. The rotary symmetric design of the distributor body promotes turning operation as the preferred production technique.

Preferably, the distributor body is formed to its final shape by the turning operation, meaning that virtually no further shaping of the one and only distributor body is needed before positioning it in its operational position.

According to a preferred embodiment of the inventive method, the distributor body is attached to an adjacent side wall of the fuel injector by means of welding or brazing. Preferably, the side wall is formed by a cylinder with a circular inner periphery, as described above for the preferred embodiment of the fuel injector. Then, the circular outer periphery of the part of the distributor that defines an end wall can easily be fitted into or on the end of the cylinder and be attached thereto.

The object of the invention is also achieved by means of an engine comprising a combustion chamber, characterized in that it comprises a fuel injector according to the invention for the injection of fuel into the combustion chamber via the fuel outlets of the fuel injector. It should be understood that any motor or engine with a combustion chamber is included in the scope of protection thereby claimed. The motor/engine may comprise one or more combustion chambers, and the outlets from the collector chamber of the fuel injector may lead to a single combustion chamber for injection of fuel into the latter via a plurality of injection locations, for example for even distribution of fuel as in the case of a spray bar in a jet engine afterburner. The fuel may also be distributed to a plurality of combustion chambers, one or more outlets thereby communicating with or leading to each combustion chamber, and different outlets leading to different combustion chambers.

According to a preferred embodiment, the engine it is a jet engine and the combustion chamber is an afterburner chamber. Preferably, the jet engine is positioned in an airplane.

Such a jet engine then comprises a plurality of fuel injection tubes connected to said plurality of outlets of the fuel injector and extending into the afterburner chamber. The afterburner chamber defines a channel with a radial direction and a longitudinal direction. The fuel injection tubes are directed from an outer radial position inwards towards the longitudinal axis of the afterburner, and they should be angularly evenly distributed around said axis or around the periphery of the afterburner wall.

In the preferred embodiment described above, the engine further comprises a radial flame holder and the fuel injector tubes extend into the afterburner chamber upstream the radial flame holder as seen in the gas flow direction in the afterburner.

Further features and advantages of the present invention will be presented in the following detailed description of a preferred embodiment of the invention.

BRIEF DESCRIPTION OF DRAWINGS

A preferred embodiment of the invention will now be described by way of example with reference to the annexed drawings on which.

DETAILED DESCRIPTION

Figure 1:
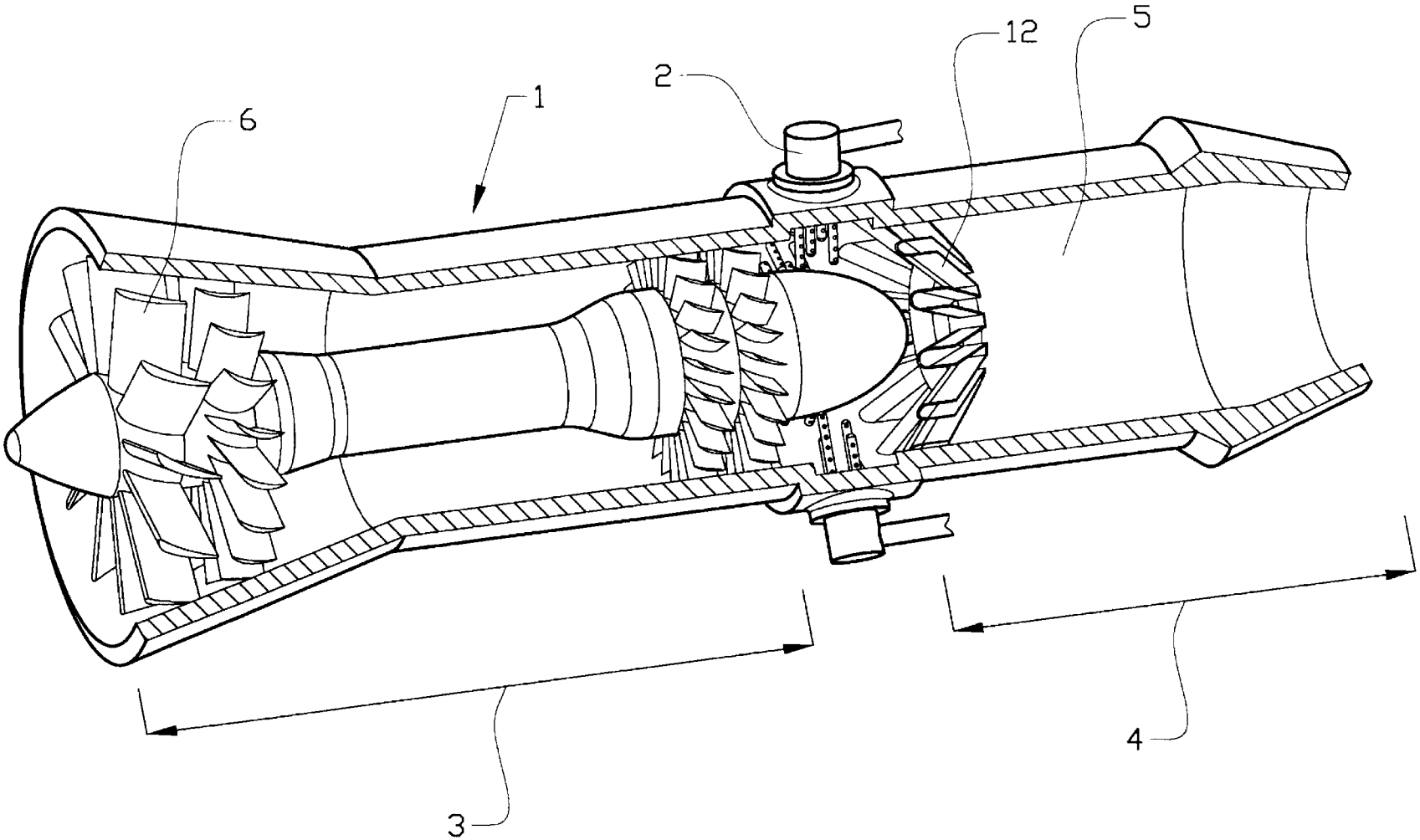
FIG. 1 is a schematic cross-section of a jet engine equipped with an afterburner and a fuel injector according to the invention.
Figure 2:
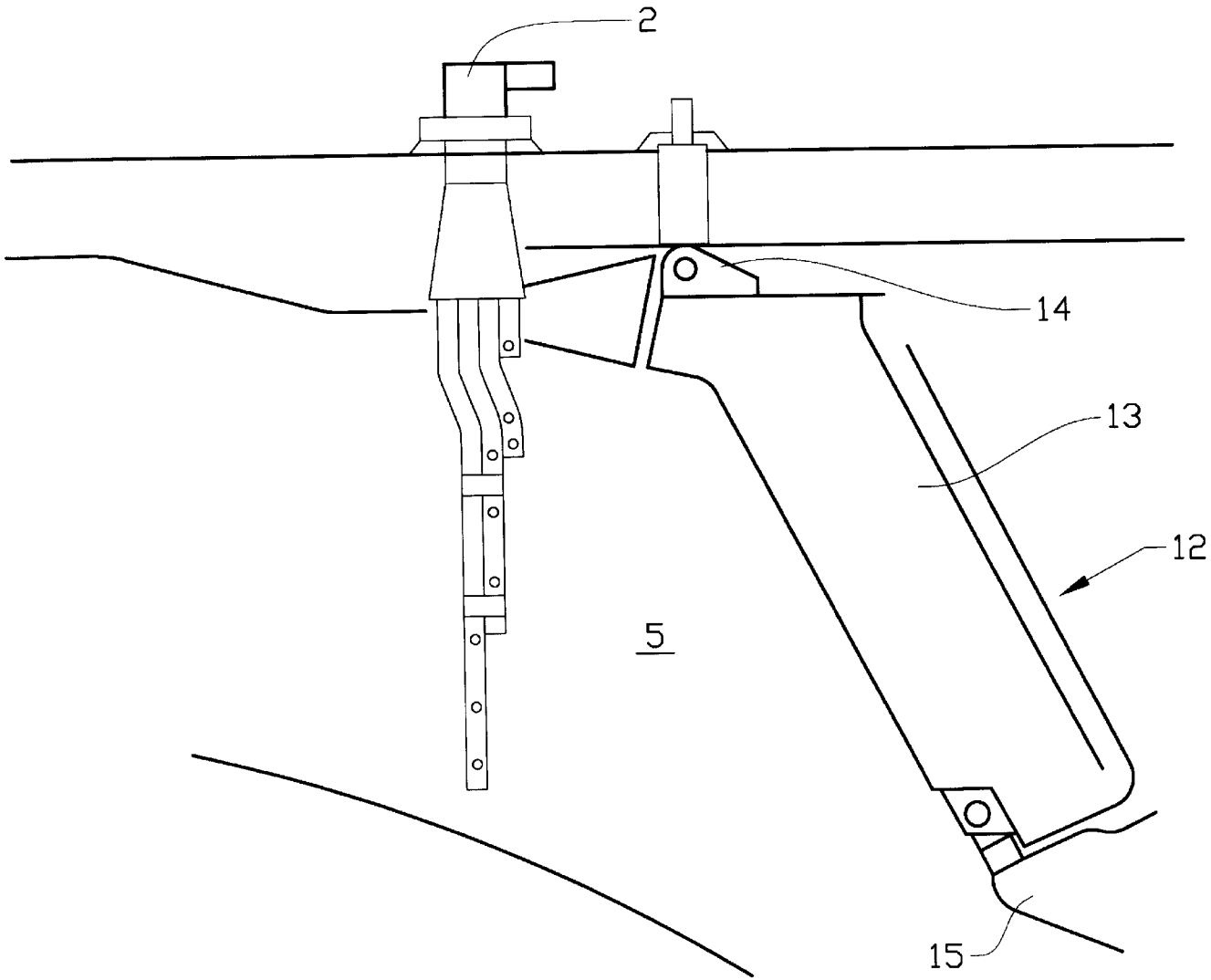
FIG. 2 is an enlarged side view of a part of the afterburner of the jet engine according to FIG. 1, with a fuel injector according to the invention.

FIG. 1 shows a jet engine 1 equipped with a plurality of fuel injectors 2 one of which is shown in the figure. The engine comprises a gas turbine section 3 and an afterburner section 4, the gas turbine section 3 being arranged upstream the afterburner section 4 as seen in a gas flow direction through the engine 1. The fuel injectors are arranged in a circular arrangement around the inner periphery of the afterburner 4 for the purpose of injecting fuel into the interior of the afterburner 4, that is the afterburner chamber 5. Here, the engine 1 comprises twenty four fuel injectors 2 in said circular arrangement.

The gas turbine section 1 comprises a plurality of rows of turbine blades 6 arranged in a way known per se. Hot gases are emitted from the turbine section 3 into the afterburner section 4.

Each fuel injector 2 comprises a fuel collector chamber 7, a fuel inlet 8 into the collector chamber 7, a fuel inlet pipe 9, a plurality of fuel outlets 10 from the collector chamber 9 and a corresponding plurality of outlet tubes or injector tubes 11 that lead from said outlets 10 into the afterburner chamber 5. Here, each fuel injector 2 comprises four outlets and four injector tubes 11. However, it is also contemplated to equip each fuel injector 2 with only two or three injector tubes 11, or more than four such tubes.

Adjacent to and downstream the row of fuel injectors 2, as seen in the gas flow direction in the engine 1, there is provided a radial flame holder 12. The flame holder 12 has the task of regulating the gas flow conditions, in particular to reduce the flow velocity, in the afterburner 4 in order to permit optimal combustion of the fuel introduced into the latter via the injector tubes 11. The flame holder 12 comprises a row of stays or struts 13 each of which extends radially from an outer peripheral connection 14 with the inner periphery of the afterburner wall to an inner ring 15. In a preferred embodiment there are two fuel injectors 2 located in each angle sector between two of the struts or stays 13.

Figure 3:
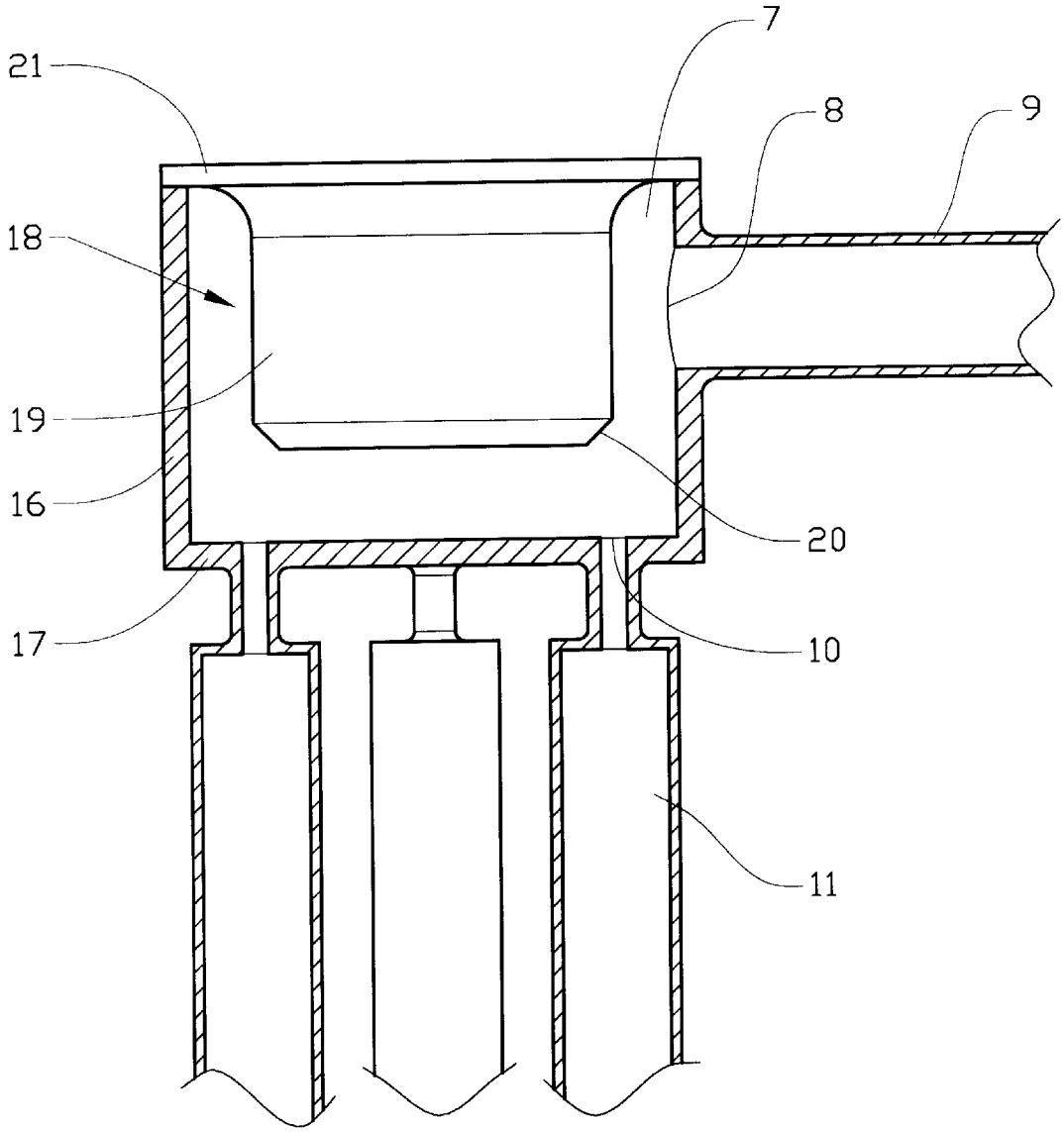
FIG. 3 is a side view of a cross-section, in a further enlarged scale, of a part of the fuel injector according to the invention shown in isolation from other engine parts.
Figure 4:
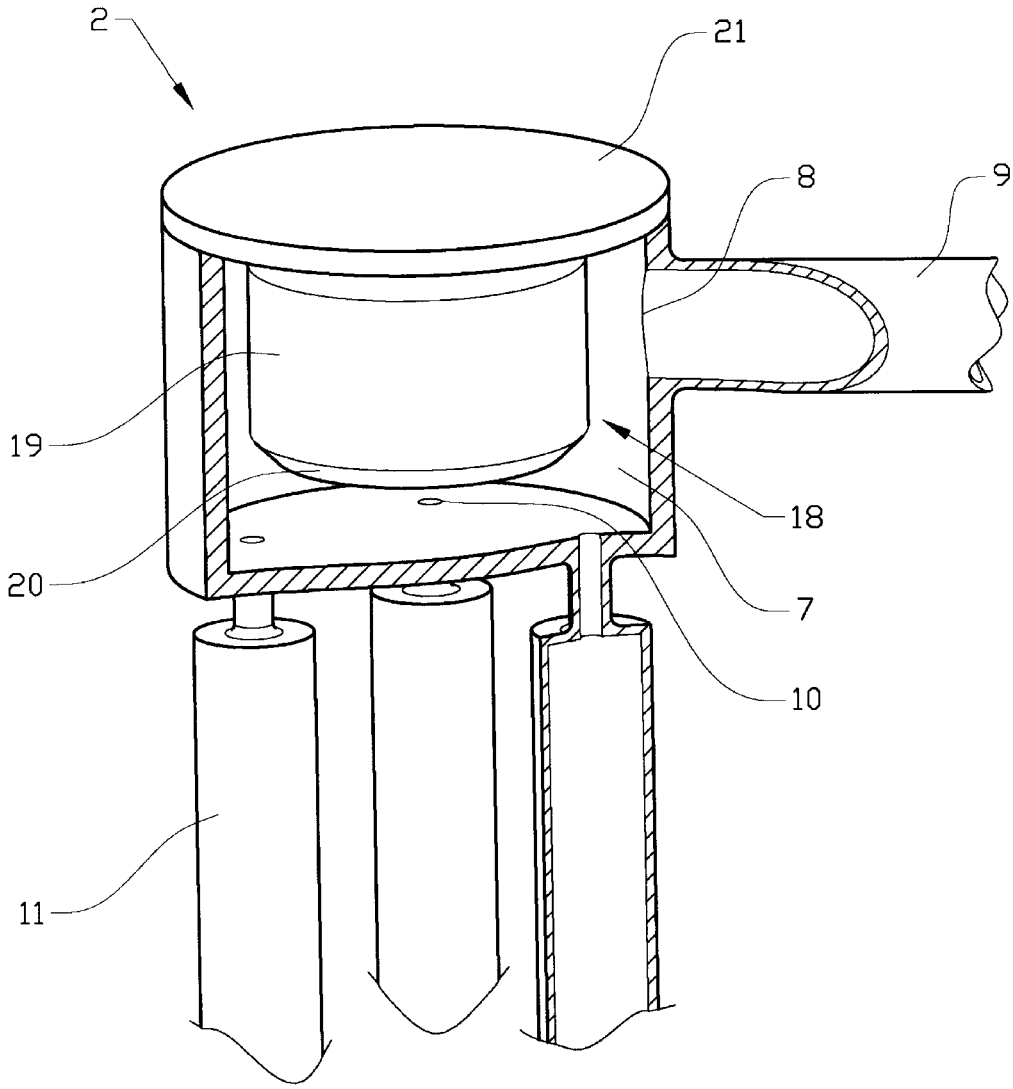
FIG. 4 is a perspective cross-section of the part shown in FIG. 3.

With reference to FIG. 3 and FIG. 4 a more detailed description of the fuel injector 2 will now be given.

The collector chamber 7 of the injector 2 is delimited by a cup-shaped body that has a cylindrical side wall with a circular inner periphery 16 and a generally flat, circular end wall 17. The angle between the side wall 16 and the plane of the end wall 17 is 90 degrees. Preferably, the cup-shaped body 16, 17 has been produced by pin milling a work piece. The cup-shaped body 16, 17 has a width of 11.5 cm and a substantially smaller wall thickness, for example in the order of 1–5 mm. It is made of a metal or metal alloy. The fuel inlet 8 is provided in the side wall 16 and the fuel outlets 11 are provided in the end wall 17. The center axis of the inlet pipe 9 is directed towards the center axis of the cup-shaped body 16, 17, such that the fuel introduced via the inlet 8 has a flow direction generally towards the center of the collector chamber 7.

The fuel injector 2 further comprises a fuel distributor 18 that protrudes into the collector chamber 7 from an opposite end of the chamber 7 with regard to the first end wall 17 mentioned above. The fuel distributor comprises a fuel distributor body 19 that has a diameter that is smaller than the inner diameter of the side wall 16, thereby leaving a spacing between side wall 16 and distributor body 19 free for flow of the fuel introduced via the inlet 8. The spacing is larger than 0.5, preferably approximately 1 mm for the injector in question. The distributor 18, or at least the body 19, is rotary symmetric in the respect that it has a generally circular outer periphery along its entire length. When mounted, it is coaxial (coinciding rotational and center axis) with the cylinder that defines the side wall 16 and, thus, positioned in the center of the latter.

The distributor body 19 ends at a given distance from the first end wall 17, thereby leaving a sufficient spacing between the body 19 and the end wall 17 to guarantee a sufficient and stable flow of fuel out of the outlets 10.

Nevertheless, the distributor body 19 shall extend such a distance towards the first end wall 17 that it, if projected on the side wall 16, shall cover the inlet 8 in order to suppress fuel jet oscillations in the collector chamber 7. The free end of the body 19 that points at the first end is rounded, chamfered or beveled, such that the free end of the body 19 defines a truncated cone 20, in order to further improve the flow conditions in the collector chamber 7.

Opposite to the free end of the distributor body 19 the fuel distributor 18 presents a circular flange 21 that has a diameter that is equal to or larger than the inner diameter of the cylindrical side wall 16 at its end portion opposite to the end where the first end wall 17 is located. The flange 21 defines a second end wall that is located opposite to the first end wall 17. The flange 21 and the distributor body 19 defines a solitaire formed by turning of one and the same work piece in a lathe. The flange is then attached to the side wall 16, preferably by means of welding. Thus the collector chamber 7 is delimited by the two opposite end walls, defined by the first end wall 17 and the fuel distributor 18, and the cylindrical side wall 16.

It should be stated that, according to this preferred embodiment, the distributor body 19 has generally the same diameter along its whole length, apart from the truncated cone part 20 and the smooth transition region in which the body 19 transits to the flange 21.

Thanks to the distributor body 19, the incoming fuel jet is broken up within a rather short distance from the inlet 8, the generation of fuel wave oscillations is suppressed, and the fuel mass flow rate out of the collector chamber 8 and the injector 2 becomes stable. A further advantage of the geometrical features of the distributor 18 is that it becomes unnecessary to adjust the angular position of the distributor body 19 in relation to the inlet 8 and the outlets 10 when the distributor is attached to the adjacent wall 16.

It should be realized that the above presentation of the invention has been made by way of example, and that alternative embodiments will be obvious for a man skilled in the art without going beyond the scope of protection as claimed in the annexed patent claims supported by the description and the annexed drawings.

For example, the invention is not restricted to only one inlet 8 into the collector chamber 9, but could consist of more than one such inlet.

It should be understood that, according to the invention, each of a plurality of fuel injectors or spray bars arranged around an after-burner chamber should be provided with the kind of fuel distributor that has been described above.

It should also be realized that, apart from its oscillation-suppressing function, the distributor body 19 also acts as a mixer in the sense that it improves the mixing of gaseous and liquid fuel that is introduced into the collector chamber 7.

The invention claimed is:

1. A fuel injector (2), comprising: a chamber (7) with a fuel inlet (8) and a plurality of fuel outlets (1); and a fuel distributor (18) arranged in the chamber (7) to distribute fuel introduced into the chamber (7) via the fuel inlet (8) to the outlets (10), said chamber (7) being delimited by at least one side wall (16) provided with said fuel inlet (8) and a first end wall (17) provided with said fuel outlets (10), wherein the fuel distributor (18) comprises a generally rotary symmetric distributor body (19) extending towards the first end wall (17) and ends at a given distance from the first end wall (17) and thereby being positioned in front of the fuel inlet (8) and cover the fuel inlet (8) when projected on the side wall (16).

2. A fuel injector according to claim 1, wherein said fuel distributor (18) defines a lid or plug that forms an end wall (21) in relation thereto.

3. A fuel injector according to claim 2, wherein the fuel inlet (8) is provided in the side wall (16) and that the outlets (10) are provided in an end wall (17).

4. A fuel injector according to claim 3, wherein the fuel outlets (10) are provided in an end wall (17) opposite to an end wall (21) that is formed by the fuel distributor (18) or to which the fuel distributor (18) is attached.

5. A fuel injector according to claim 1, wherein a side wall (16) forms a cylinder that has a generally circular inner periphery.

6. A fuel injector according to claim 5, wherein the distributor body (19) is concentric with the cylinder (16).

7. A fuel injector according to any one of claims 1–6, wherein the distributor body (19) is located in front of the fuel inlet (8) and covers the fuel inlet (8).

8. A method of manufacturing a fuel injector comprising a chamber (7) with a fuel inlet (8) and a plurality of fuel outlets (1) and a fuel distributor (18) arranged in the chamber (7) to distribute fuel introduced into the chamber (7) via the fuel inlet (8) to the outlets (10), said chamber (7) being delimited by at least one side wall (16) provided with said fuel inlet (8) and a first end wall (17) provided with said fuel outlets (10), wherein the fuel distributor (18) comprises a generally rotary symmetric distributor body (19) extending towards the first end wall (17) and ends at a given distance from the first end wall (17) and thereby being positioned in front of the fuel inlet (8) and cover the fuel inlet (8) when projected on the side wall (16) and the distributor body (19) is produced by subjecting a work piece to a turning operation.

9. A method according to claim 8, wherein the distributor body (19) is formed to its final shape by the turning operation.

10. A method according to claim 8 or 9, wherein the fuel distributor (18) is attached to an adjacent side wall (16) of the fuel injector (1) by means of welding or brazing.

11. An engine comprising:

a combustion chamber including a fuel injector (2) comprising a chamber (7) with a fuel inlet (8) and a plurality of fuel outlets (1) and a fuel distributor (18) arranged in the chamber (7) to distribute fuel introduced into the chamber (7) via the fuel inlet (8) to the outlets (10), said chamber (7) being delimited by at least one side wall (16) provided with said fuel inlet (8) and a first end wall (17) provided with said fuel outlets (10), wherein the fuel distributor (18) comprises a generally rotary symmetric distributor body (19) extending towards the first end wall (17) and ends at a given distance from the first end wall (17) and thereby being positioned in front of the fuel inlet (8) and cover the fuel inlet (8) when projected on the side wall (16), said fuel injector (2) configured to inject fuel into the combustion chamber (5) via the fuel outlets (10) of the fuel injector (1).

12. An engine according to claim 11, wherein said engine is a jet engine and the combustion chamber (5) is an afterburner chamber.

13. A jet engine comprising an afterburner chamber, the afterburner chamber comprising:

a fuel injector (2), comprising a chamber (7) with a fuel inlet (8) and a plurality of fuel outlets (10), and comprising a fuel distributor (18) with a generally rotary symmetric body (19) that is arranged in the chamber (7) for the purpose of distributing fuel introduced into the chamber (7) via the fuel inlet (8) to the outlets (10), and further comprising fuel injection tubes (11) connected to said fuel outlets (10) and extending into the afterburner chamber (5).

14. A jet engine according to claim 13, further comprising:

a radial flame holder (12) and that the fuel injector tubes (11) extend into the afterburner chamber (5) upstream the radial flame holder (12) as seen in the gas flow direction in the afterburner.

15. A fuel injector (2) comprising a chamber (7) with a fuel inlet (8) and a plurality of fuel outlets (10) arranged through walls defining the chamber (7), and a fuel distributor body positioned at a distance from both the inlet (8) and the outlets (10) and positioned in front of the inlet (8), wherein a first wall (17) comprising the fuel outlets forms a substantially flat bottom surface in the chamber (7) and a second wall comprising the fuel inlet forms a side wall extending from the first wall (17).

16. A fuel injector (2) comprising a chamber (7) with a fuel inlet (8) and a plurality of fuel outlets (10) arranged through walls defining the chamber (7), and a fuel distributor body positioned at a distance from both the inlet (8) and the outlets (10) and positioned in front of the inlet (8), wherein a second wall comprising the fuel inlet forms a side wall extending from a first wall (17).

17. A fuel injector (2) according to claim 16, wherein the outlets (10) extend through a first wall (17) defining the chamber (7), which has a different inclination relative to a second wall, through which the inlet (8) extends.

18. A fuel injector (2) according to claim 16, wherein the chamber (7) has a cylindrical shape.

19. A fuel injector (2) according to claim 16, wherein the fuel distributor (18) has a rotary symmetrical shape.

20. A fuel injector (2) according to claim 16, wherein the fuel distributor (18) has an outer shape corresponding to an inner shape of the chamber (7).

21. A fuel injector (2) according to claim 16, wherein the fuel distributor (18) is rotationally fixed relative to the chamber (7).

* * * * *